United States Patent [19]

Fudge

[11] 4,015,250

[45] Mar. 29, 1977

[54] ALARM FOR REMOVAL OF A FIRE EXTINGUISHER

[75] Inventor: William L. Fudge, Minneapolis, Minn.

[73] Assignee: Larsen's Manufacturing Company, Minneapolis, Minn.

[22] Filed: Sept. 2, 1975

[21] Appl. No.: 609,350

[52] U.S. Cl. ..... 340/280; 169/51; 340/274 R

[51] Int. Cl.[2] ..... G08B 13/08

[58] Field of Search ..... 340/280, 272, 274 R; 200/61.81, 61.93; 169/23, 51

[56] References Cited

UNITED STATES PATENTS

| | | | |
|---|---|---|---|
| 2,279,933 | 4/1942 | Wells | 200/61.81 |
| 2,683,260 | 7/1954 | Lavelle | 340/280 |
| 2,965,890 | 12/1960 | Robillard | 340/280 |
| 3,067,822 | 12/1962 | Hattenhauer | 169/51 |
| 3,340,522 | 9/1967 | Chick et al. | 200/61.93 |
| 3,644,920 | 2/1972 | Cartledge | 340/280 |
| 3,797,006 | 3/1974 | Reininger | 340/274 |
| 3,842,410 | 10/1974 | Gopperton | 200/61.93 |
| 3,893,095 | 7/1975 | DeJong | 340/280 |

*Primary Examiner*—Glen R. Swann, III
*Attorney, Agent, or Firm*—Merchant, Gould, Smith, Edell, Welter & Schmidt

[57] ABSTRACT

A source of electrical energy, a normally closed momentary contact switch, and an electrically energizable warning device are connected in a series circuit and mounted with respect to a fire extinguisher mount such as a cabinet or bracket so that the switch is held open when the extinguisher is fully installed in the mount, but is allowed to close as an incident to removal of the extinguisher from the mount, as by opening the cabinet door. A manually operable switch may be added for disabling the normal circuit operation when desired. The circuitry may be contained in a housing hingedly connected to the mount, to facilitate servicing the circuit without removing the extinguisher.

3 Claims, 8 Drawing Figures

FIG. 2
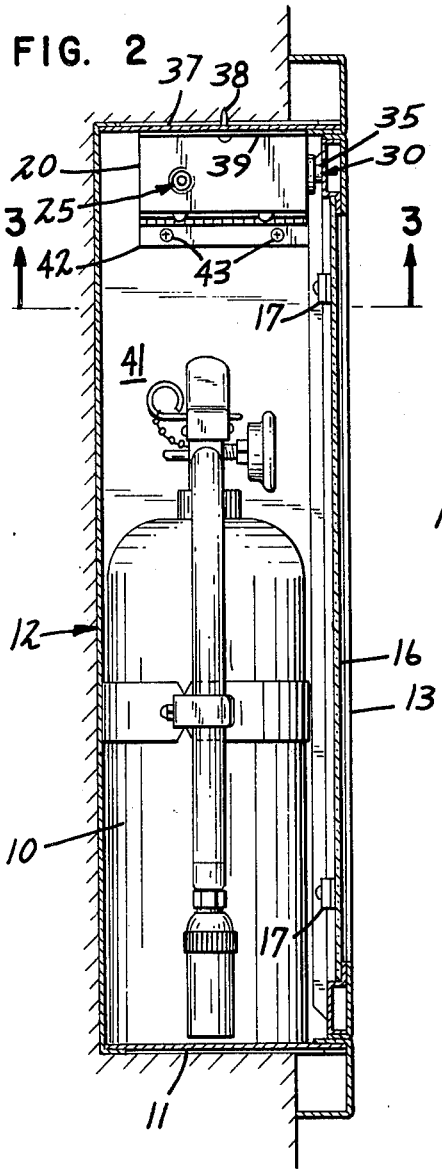
FIG. 1
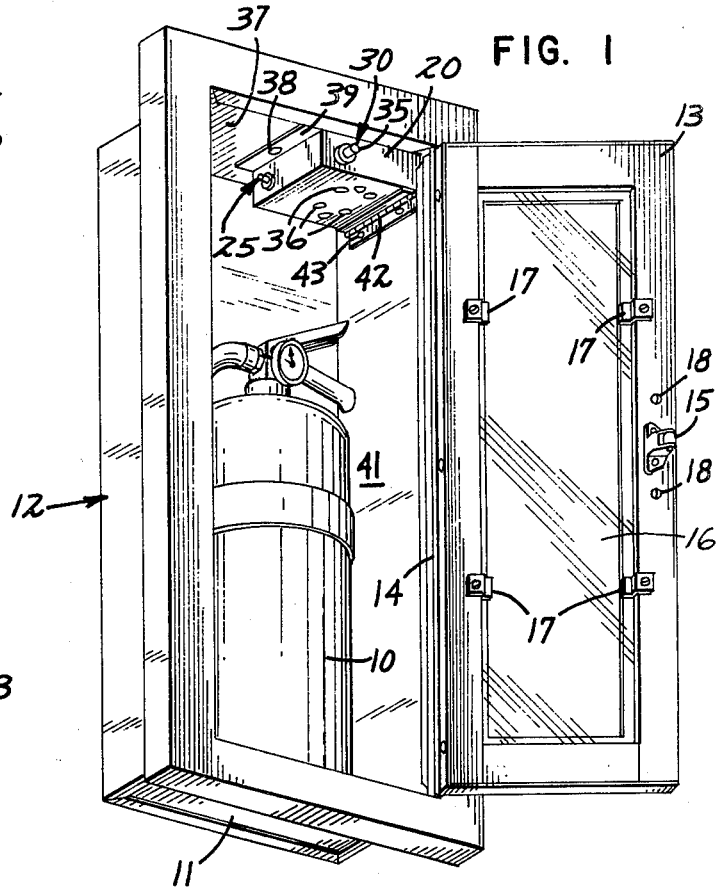
FIG. 3
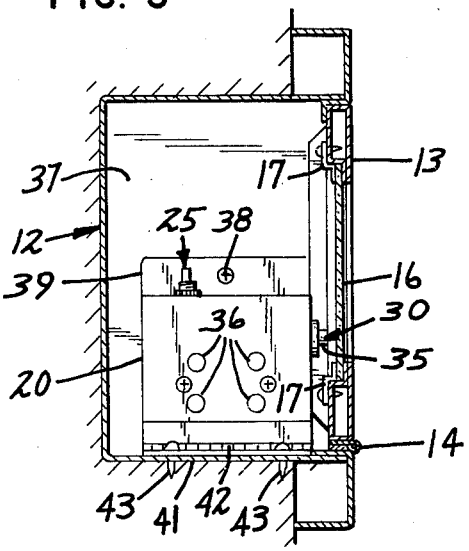
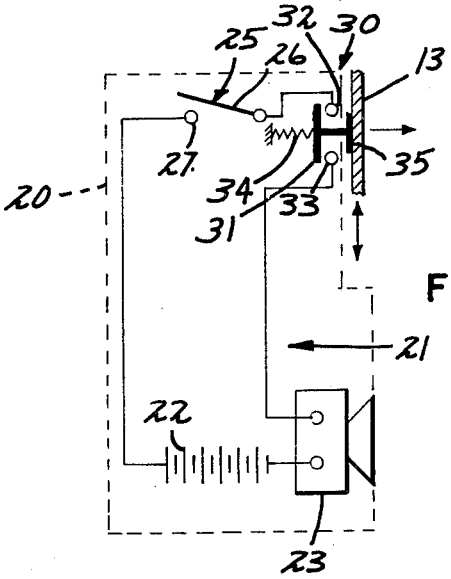
FIG. 4

ALARM FOR REMOVAL OF A FIRE EXTINGUISHER

BACKGROUND OF THE INVENTION

This invention relates to security systems, and comprises a method of and apparatus for giving warning when a security device such as a fire extinguisher is removed from its normal location.

As security devices, fire extinguishers must inherently remain available for public access when they are needed. On the other hand, they are susceptible to pilfering, vandalism, juvenile curiosity, and general intermeddling by the very public for whose protection they are provided and maintained.

It has been found that interference with fire extinguishers is minimized if a very audible alarm is sounded as an incident to removal of the device from its public place. Such an alarm has the further advantage, in the case of a legitimate removal of the fire extinguisher, of calling general attention to the situation so that assistance may be summoned even while the original discoverer is devoting his attention to extinguishing or controlling the fire.

Two general types of fire extinguisher mountings are known. The first comprises a closed cabinet within which the extinguisher is contained, and from which it may be removed by opening a door, for example. The second is a simple wall bracket into which the extinguisher is received: it may be located behind a frangible panel which must be broken according to instructions in order to reach the extinguisher.

SUMMARY OF THE INVENTION

My invention is embodied in apparatus adapted to be positioned within the housing of the first type of mounting, or directly on the second type of mounting. It includes a warning device electrically actuated as an incident to removal of the extinguisher from the housing or bracket, and comprises a series electric circuit including the warning device, a source of electrical energy, and switching means arranged to complete the circuit to the device for initiating the warning.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there are illustrated and described certain preferred embodiments of the invention

BRIEF DESCRIPTION OF THE DRAWING

In the drawing,

FIG. 1 is a perspective view of a first embodiment of the invention;

FIG. 2 is a side view of the invention, partsbeing shown in section;

FIG. 3 is a bottom view in section along the line 3—3 of FIG. 2;

FIG. 4 is a diagram of a circuit used in practicing the invention;

DESCRIPTION OF THE PREFERRED EMBODIMENTS

Figure 5:
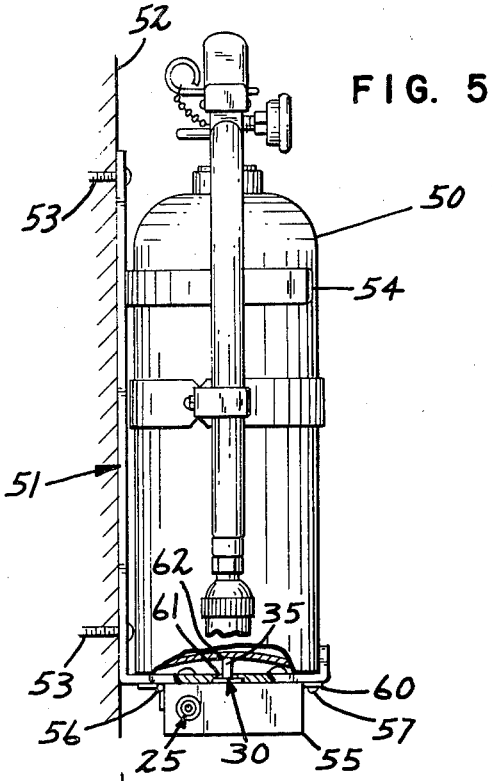
FIGS. 5 and 6 are front and side views respectively of a second embodiment of the invention.

Turning first to FIGS. 1 and 2, a fire extinguisher 10 is shown as contained within and resting on the bottom 11 of an outer cabinet 12 having an access door 13 secured to the cabinet by a vertically extending hinge 14. The door is retained in its closed position by a suitable spring catch 15, and includes a transparent panel 16 maintained in place by clips 17. The cabinet may have the usual notice to the public as to its contents, and access is obtained thereto by a handle (not shown) secured to door 13 as by screws 18.

Contained within cabinet 12 is an inner cabinet 20 containing a circuit 21 including, as shown in FIG. 4, a source 22 of electrical energy, an electrically energizable warning device 23 such as a horn or a buzzer, and switch means including a single-pole single-throw switch 25, having a blade 26 and a fixed contact 27, and a normally closed, momentarily actuable switch 30, including a blade 31 arranged to bridge a pair of contacts 32, 33, and having a spring 34 acting to normally bias motion of blade 31 into engagement with the fixed contacts. An actuator 35 extends out of inner cabinet 20 to a position where it is engaged by door 13 when the latter is closed, to maintain an open electrical circuit.

Inner cabinet 20 is apertured at 36 adjacent device 23. It is secured to the top 37 of housing 12 by a screw 38 passing through a flange 39, and to the side 41 of housing 12 by a hinge 42 fastened to the housing by further screws 43. It will be evident that as screw 38 is loosened, housing 21 may pivot about hinge 42 to permit ready replacement of source 22, or other servicing for the equipment.

It will be evident that when door 13 is opened as an incident to removing extinguisher 10 from the mounting cabinet 12, the pressure on actuator 35 is released, and switch 30 of switch means 24 closes to complete the series circuit and energize device 23. This initiates sounding of a warning which continues as long as door 13 is open. Switch 25 is provided to permit door 13 to be opened, as for service of extinguisher 10 or circuit 21, without continuous sounding of the warning.

Figure 6:
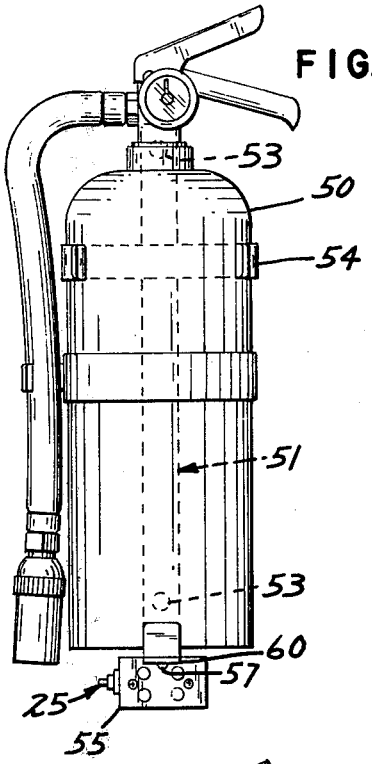

A second embodiment of the invention is shown in FIGS. 5 and 6. Here a fire extinguisher 50 is received in a mounting bracket 51 secured to a wall 52 by suitable fasteners 53, and includes a resilient member 54 gripping the body of the extinguisher. In this embodiment, circuit 21 is contained in a housing 55 secured to bracket 51 by hinge 56 at the rear and a screw 57 and flange 60 at the front. In this embodiment, the actuator projects upwardly from housing 55 through an aperture 61 in bracket 51 to engage the bottom of the extinguisher at 62, which thus maintains switch 30 in its open condition as long as the extinguisher is present. When the extinguisher 50 is tilted forward as an incident to removal of the extinguisher from bracket 51, the force on actuator 35 is released and operation of the warning device is initiated. Switch 25 in this embodiment of the invention is located in the side of housing 55 near the rear, for manual operation to permit servicing of the extinguisher without continuous sounding of the warning.

Figure 7:
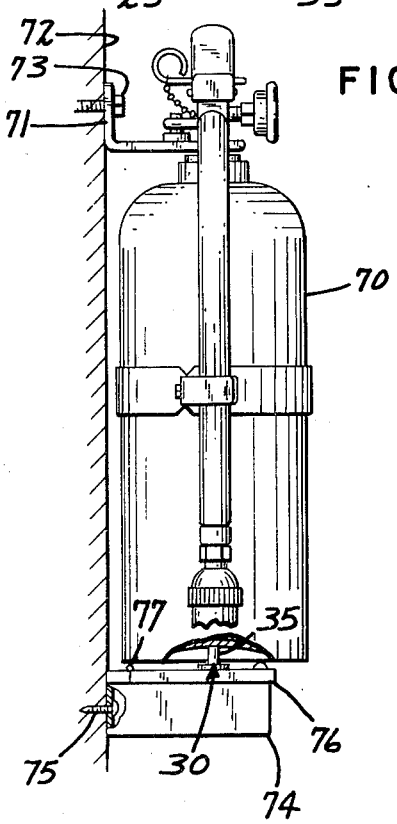
FIGS. 7 and 8 are front and side views respectively of a further embodiment of the invention.
Figure 8:
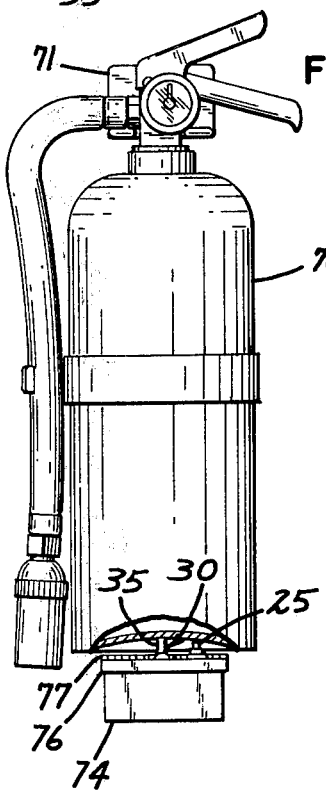

The embodiment of FIGS. 7 and 8 shows extinguisher 70 supported at its neck only by a short bracket 71 secured to wall 72 by fasteners 73. In this embodiment, housing 74 is secured to wall 72 by fasteners 75, and is provided with a cover 76 hinged at 77, in which switch 30 is mounted and to which actuator 35 projects upwardly to engage the bottom of fire extinguisher 70. This maintains the series circuit open until, as an incident to its removal, the fire extinguisher is drawn forward and lifted. In this embodiment of the invention, switch 25 is also mounted in cover 76 so that it is not accessible without removal of the fire extinguisher. When access to the contents of housing 74 is desired, as for replacing a battery, the extinguisher is removed, which gives a short alarm: switch 25 is then actuated to disable the series circuit, cover 76 is raised and servicing is performed. The cover is then closed, switch 25 is actuated to reenable the series circuit, the alarm sounds briefly, and the fire extinguisher is replaced to silence the alarm.

From the foregoing, it will be evident that I have invented a new and useful method of and apparatus for giving audible warning incident to the removal of a fire extinguisher from a support or bracket, and that the invention includes means for disabling the warning arrangement in order to service the extinguisher or the incidental circuitry without continuous sounding of the alarm.

Various characteristics and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. In combination:

a fire extinguisher mount comprising a first cabinet for containing said fire extinguisher, having a door to be opened to gain access thereto;

an electric module including a second cabinet, a source of electrical energy, an electrically energizable alarm device, and switch means for controlling energization of said device from said source;

and hinge means positioning said second cabinet within said first cabinet so that said switch means prevents energization of said device when said door is closed, but acts, as an incident to opening of said door, to cause energization of said device.

2. The structure of claim 1 wherein said second cabinet may be pivoted on the hinge of said positioning means to enable servicing of said module without removing said module from said first cabinet.

3. In combination:

an outer cabinet having a door;

an inner cabinet having an open bottom and containing an element replaceable through said bottom;

a switch actuator extending out of said inner cabinet;

and means hingedly mounting said inner cabinet within said outer cabinet for pivotal movement between a first position, in which said actuator engages the inside of said door and said bottom engages said outer cabinet, and a second position in which said element is accessible for replacement.

* * * * *